US011643307B2

(12) United States Patent
Ritala

(10) Patent No.: US 11,643,307 B2
(45) Date of Patent: May 9, 2023

(54) WIRE ROPE HOIST LIMITER

(71) Applicant: Konecranes Global Oy, Hyvinkää (FI)

(72) Inventor: Mikko Ritala, Hyvinkää (FI)

(73) Assignee: Konecranes Global Oy, Hyvinkää (FI)

( * ) Notice: Subject to any disclaimer, the term of this patent is extended or adjusted under 35 U.S.C. 154(b) by 0 days.

(21) Appl. No.: 17/609,480

(22) PCT Filed: May 13, 2020

(86) PCT No.: PCT/FI2020/050318
§ 371 (c)(1),
(2) Date: Nov. 8, 2021

(87) PCT Pub. No.: WO2020/229731
PCT Pub. Date: Nov. 19, 2020

(65) Prior Publication Data

US 2022/0250882 A1 Aug. 11, 2022

(30) Foreign Application Priority Data

May 13, 2019 (FI) ..... 20195395
May 28, 2019 (FI) ..... 20195443

(51) Int. Cl.
*B66D 1/50* (2006.01)
*B66D 1/56* (2006.01)
*B66C 13/50* (2006.01)

(52) U.S. Cl.
CPC ..... *B66D 1/56* (2013.01); *B66C 13/50* (2013.01)

(58) Field of Classification Search
CPC .. B66D 1/56; B66D 1/485; B66D 3/24; B66C 13/50; B66C 13/105; B66C 13/40; B66C 13/46; B66C 15/065; B66C 1/0275
See application file for complete search history.

(56) References Cited

U.S. PATENT DOCUMENTS 8,401,814 B1 * 3/2013 Kureck ..... B66D 1/56 254/270
8,657,134 B2 2/2014 Morath
2011/0089131 A1 * 4/2011 Morath ..... B66C 13/50 254/269

FOREIGN PATENT DOCUMENTS

CN 106115494 A 11/2016
CN 206417804 U 8/2017
CN 206427929 U 8/2017
DE 202009014066 U1 * 4/2011 ..... B66C 13/46
JP H01106496 U 7/1989
KR 20180105784 A 10/2018
(Continued)

OTHER PUBLICATIONS

Finnish Patent and Registration Office, Search Report, Application No. 20195443, dated Dec. 2, 2019, 1 page.
(Continued)

*Primary Examiner* — Emmanuel M Marcelo
(74) *Attorney, Agent, or Firm* — Ziegler IP Law Group, LLC

(57) ABSTRACT

A wire rope hoist limiter device, includes a fastener arranged to be fastened around the wire rope of the wire rope hoist; a sliding weight arranged to slide along the wire rope of the wire rope hoist towards the fastener; and a detector arranged to be fastened to the wire rope of the wire rope hoist by means of the fastener. The detector is arranged to detect the sliding weight at a certain distance from the fastener and to give a stop signal for the wire rope hoist in response.

19 Claims, 4 Drawing Sheets

(56) References Cited

FOREIGN PATENT DOCUMENTS

| | | | | |
|---|---|---|---|---|
| WO | WO-0232800 A2 * | 4/2002 | ..... | B66B 1/32 |
| WO | 2009089628 A1 | 7/2009 | | |

OTHER PUBLICATIONS

Finnish Patent and Registration Office, Search Report, Application No. 20195395, dated Nov. 25, 2019, 1 page.
Notification of Transmittal of International Preliminary Report on Patentability, Application No. PCT/FI2020/050318, dated May 27, 2021, 27 pages.
Notification of Transmittal of The International Search Report and The Written Opinion of The International Searching Authority, or The Declaration, Application No. PCT/FI2020/050318, dated Aug. 18, 2020, 6 pages.
Written Opinion of the International Searching Authority, Application No. PCT/FI2020/050318, dated Aug. 18, 2020, 7 pages.

* cited by examiner

WIRE ROPE HOIST LIMITER

FIELD

The aspects of the disclosed embodiments relate to a wire rope hoist limiter device, a wire rope hoist control system, a wire rope hoist limiter system and a method for providing the wire rope hoist with a limiter device. The disclosed embodiments relate especially to a wire rope hoist limiter device adaptable for mounting on different types of wire hoists.

BACKGROUND

This section provides the reader with useful background information without necessarily intending to admit as prior art the technique described herein.

When operating a wire rope hoist, mechanisms are employed which limit the maximum height to which a load can be hoisted in a significantly vertical movement. These mechanisms ensure that the load will not damage the structures of the wire rope hoist. In some countries, the limiter mechanisms are also compulsory. In addition to the significantly vertical movement, for example, bridge cranes are controlled horizontally by moving the trolley or the bridge, each on its own rails. The hoist is generally fastened to the trolley, said trolley comprising a rope drum and a rope end termination for winding and fastening the wire rope. The hoist may also be located on a jib. The jib may be a crane rotating about the vertical axis or a non-rotating fixedly mounted crane.

Previously there is known a limiter mechanism, in which an element triggering the limiter device is mounted on the roping of the wire rope hoist. However, the previously known mechanism requires a specific type of roping, and parts of the limiter device are mounted on structures of the wire rope hoist, which must be adapted to this. This type of a known limiter device is disclosed in the patent publication U.S. Pat. No. 8,657,134 B2.

All wire rope hoists do not have sufficient backup for situations where one of the limiter mechanisms fails or no limiter mechanisms have been installed. There is thus a need for a limiter device which is simple to mount on different types of wire rope hoists, also afterwards, and which does not require a specific type of roping or of a wire rope hoist structure.

The object of the present disclosure is to provide such a limiter device.

SUMMARY

According to a first aspect of the disclosed embodiments, a wire rope hoist limiter device is provided.

According to a second aspect of the disclosed embodiments, a wire rope hoist limiter device is provided, comprising:

a switch fastened to a fastener and arranged, when switched on, to provide a signal for stopping the wire rope hoist;

detection means arranged to cause the switching on of the switch; wherein the limiter device is arranged to be fastened to the wire rope hoist by means of a fastener which is arranged to fasten around the wire rope of the wire rope hoist; and the limiter device comprises a sliding weight arranged to slide along the wire rope of the wire rope hoist, wherein the detection means are arranged to detect, at a certain distance from the fastener, the sliding weight as it slides along the wire rope towards the fastener in order to switch on the switch; wherein the detection means do not comprise a turning lever.

The sliding weight may be fastened to the fastener by means of a flexible fastener such that the sliding of the sliding weight beyond the length of the flexible fastener is prevented.

The flexible fastener may comprise one or more of the following: a cable, a wire rope, a rope, a band, a tension spring.

The detection means may comprise a contact or contactless arrangement. The detection means may comprise a sensor arrangement which is mechanical, optical, electrical, based on ultrasound, based on electromagnetic radiation and/or magnetic, or other mechanical arrangement arranged at a certain distance from the fastener to detect the sliding weight.

An electric sensor arrangement may comprise an inductive, capacitive, piezoelectric and/or resistive sensor.

An optical sensor arrangement may comprise a sensor arrangement based on a photocell, laser, infrared light or ultraviolet light.

A sensor arrangement based on electromagnetic radiation may comprise a microwave sensor or radar.

A magnetic sensor arrangement may comprise a Hall sensor.

The weight may comprise an element, elements or material which is functionally connected to the detection means.

The sliding weight may consist of at least two parts attached to each other with an opening between them in which the wire rope of the wire rope hoist is arranged to run.

The fastener may be arranged to fasten on the wire rope of the wire rope hoist by pressing.

The fastener may be made of at least two parts which are arranged to be attached to each other such that the wire rope of the wire rope hoist is pressed in the opening remaining between the parts.

The fastener may be arranged to be fastened to different sizes of wire ropes by providing various sizes of openings.

The sliding weight may be shaped such that its first end facing the fastener is narrower than a second end.

The sliding weight may comprise at least one rotationally symmetrical end, the axis of symmetry of which is parallel with the wire rope.

The sliding weight may be arranged to move guided by the wire rope of the wire rope hoist such that the detector detects the sliding weight at a certain distance from the detector, directly from the sliding weight.

The flexible fastener can determine the idle distance of the sliding weight from the detector when the sliding weight rests on the flexible fastener. The idle distance may be greater than the said certain distance from the detector at which the detector is arranged to detect the sliding weight. The idle distance may be a freely selected distance which is greater than the said certain distance from the detector at which the detector is arranged to detect the sliding weight.

The flexible fastener may be arranged to connect the sliding weight to the fastener such that the flexible fastener settles over at least a part of the free space between the fastener and the sliding weight on a route independent of the wire rope of the wire rope hoist. The route may change its shape as the sliding weight rises.

The external parts of the detection means may be arranged to maintain their dimensions when the sliding weight moves from its rest position to the said certain distance.

According to a third aspect of the disclosed embodiments, a wire rope hoist control system is provided, which is characterized in that the control system comprises a limiter device according to an aspect of the disclosed embodiments.

The control system of the wire rope hoist may further comprise automatic control for controlling the wire rope hoist.

The control system may comprise means for data transfer by wire from the switch to the control system.

The control system comprises means for wireless data transfer from the switch to the control system.

According to a fourth aspect of the disclosed embodiments, a limiter method for a wire rope hoist is provided, a limiter device fastened to the wire rope of the wire rope hoist by means of a fastener is used, the limiter device comprising a switch fastened to the fastener and arranged, when switched on, to provide a signal for stopping the wire rope hoist, and detection means arranged to cause the switching on of the switch, wherein the detection means do not comprise a turning lever. In the method, the sliding weight comprised in the limiter device is in addition allowed to slide along the wire rope of the wire rope hoist and the switch is switched on when the detection means detect the sliding weight at a certain distance from the fastener when it slides along the wire rope towards the fastener.

According to a fifth aspect of the disclosed embodiments, a method is provided for providing the wire rope hoist with a limiter device, in which a limiter device according to the first aspect is mounted on the wire rope hoist.

According to a sixth aspect of the disclosed embodiments, a wire rope hoist limiter device is provided, comprising:

a switch fastened to a fastener and arranged, when switched on, to provide a signal for stopping the wire rope hoist;

detection means arranged to cause the switching on of the switch, wherein the limiter device is arranged to be fastened to the wire rope hoist by means of a fastener which is arranged to fasten around the wire rope of the wire rope hoist, and the limiter device comprises a sliding weight arranged to slide along the wire rope of the wire rope hoist, wherein the detection means are arranged at a certain distance from the fastener to detect the sliding weight when it slides along the wire rope towards the fastener to switch on the switch.

Different embodiments of the present disclosure are described or have been described only in connection with one or some aspects of the disclosed embodiments. A person skilled in the art understands that any embodiment of an aspect of the disclosed embodiments can be applied in the same aspect of the disclosed embodiments and in other aspects alone or in combination with other embodiments.

BRIEF DESCRIPTION OF THE FIGURES

The disclosed embodiments are described in the following by way of example with reference to the accompanying drawings.

DETAILED DESCRIPTION

In the following description, like reference signs are used to designate like parts or steps. It should be noted that the Figures presented are not entirely to scale, and that they mainly serve only the purpose of illustrating embodiments of the present disclosure.

Figure 1A:
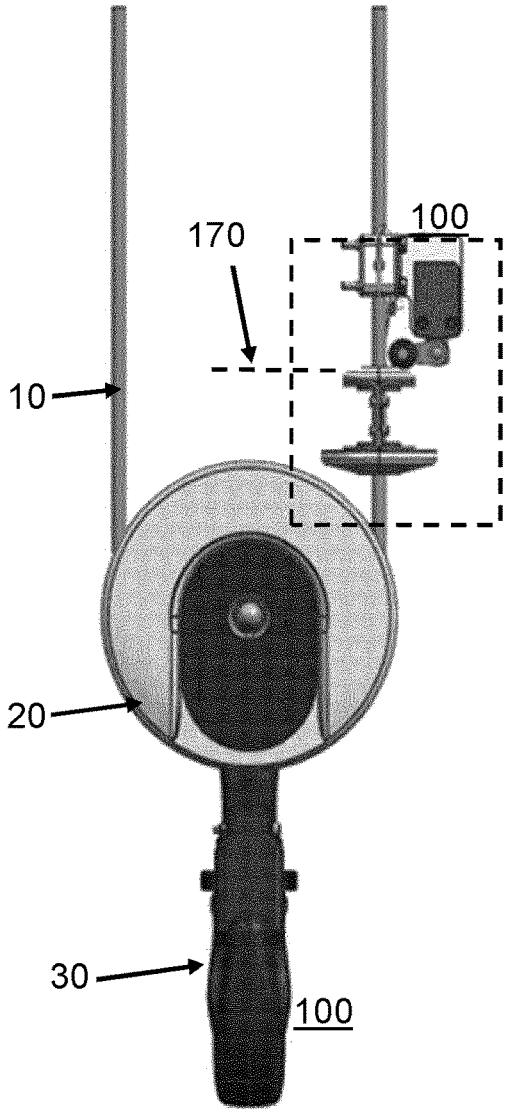
FIG. 1*a* shows schematically a wire rope hoist to which there is mounted a wire rope hoist limiter device according to one embodiment.

FIG. 1 shows schematically a wire rope hoist to which there is mounted a wire rope hoist limiter device 100 according to one embodiment. FIG. 1 shows the wire rope 10 of the wire rope hoist and a hook block 20 with a hook 30. The hook block 20 may comprise one or more sheaves, through which the wire rope 10 is fitted to run. It should be noted that although FIG. 1 shows roping, or rigging, wherein two falls are made with one rope (1×2), the wire rope hoist limiter device according to the embodiments of the present disclosure can also be used with other types of ropings (e.g. 1×4, 1×6, or 1×8). In FIG. 1, a limiter device 100 according to one embodiment of the present disclosure is fastened to the wire rope 10 of the wire rope hoist at point 170, where the movement of the hook block 20 of the wire rope hoist is at latest to be stopped.

A load can be fastened to the hook 30, for example, by means of hoisting rings, hoisting slings or chains. The hook 30 may also be fitted to lift a spreader if the wire rope hoist is used for lifting port containers. The hook 30 may also be fitted to lift a lifting beam used for lifting, for example, long, horizontal shafts. In FIG. 1, the upwards directed wire ropes may be connected to a rope drum ("left wire rope") and to a rope end termination ("right wire rope") on the wire rope hoist limiter device 100 side. Depending on the layout of the roping, the "left wire rope" may also be connected through one or more sheaves to the said rope drum. In the event of the possible swaying of the load, the entire said roping may be involved in the swaying movement and the limiter device may still function reliably. The limiter device 100 is preferably fastened on that side of the wire rope which is supported from above on the rope end termination, according to FIG. 1 on the "right-hand wire rope". With this manner of fastening, the limiter device remains at essentially the same distance from the rope end termination, for example, from a so-called wedge socket, and the section of the wire rope to which the limiter device is fastened, is not guided into contact with the sheaves.

According to FIG. 1, the wire rope 10 may run, for example, as follows: the right-hand wire rope is fastened at its upper end to the rope end termination. The wire rope runs downwards through the limiter device 100, down to the hook block 20, where the bend of the sheave is. From the sheave the wire rope continues as the left-hand wire rope from the hook block 20 upwards. Depending on the type of roping, the left-hand wire rope is guided to a rope drum at the top when the rigging is of type 1×2. If the rigging is of type 1×4, the wire rope is guided at the top via the sheave bend down again, towards the hook block 20, where it is bent again via another sheave (not shown in the Figure) back upwards and then onto a rope drum with the attachment of the second end of the wire rope 10. The falls can be implemented in a corresponding manner, for example, in 1×6 and 1×8 riggings.

Figure 1B:
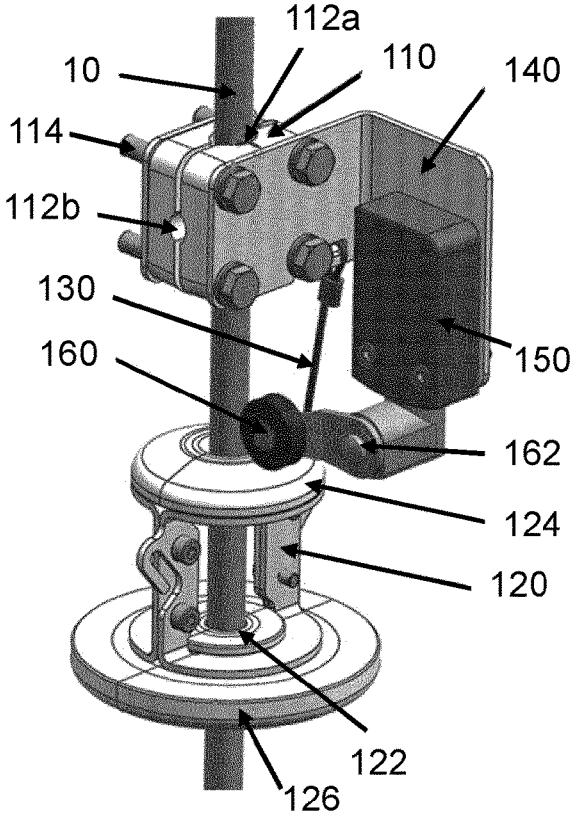
FIGS. 1*b* and 1*c* show the limiter device of FIG. 1*a* in two different modes.

FIG. 1*b* shows schematically the wire rope hoist limiter device 100 according to one embodiment. The limiter device 100 comprises a fastener 110 which is arranged to be fastened to the wire rope 10 of the wire rope hoist, for example, by pressing around the wire rope such that the fastener 110 stays in place in the desired location. The limiter device 100 further comprises a sliding weight 120 which is arranged to slide along the wire rope 10 of the wire rope hoist. The limiter device 100 further comprises a switch 150 which is fastened to the fastener 110. When switched on, the switch 150 is arranged to provide a signal for stopping the wire rope hoist and thus for preventing the hook block and/or the load from rising above the detection limit 170 set by the limiter device 100. According to one embodiment, the switch 150 comprises a microswitch.

To the switch 150 there are functionally connected detection means 160 which are arranged to detect the sliding of the weight 120 to a certain distance from the fastener 110 (or detection means 160), that is, to the detection limit 170, and to cause the switching on of the switch 150, in other words, the detection means 160 are arranged to detect the arrival of the weight 120 at the detection limit and to thus cause the switching on of the switch 150.

In one embodiment, the switch 150 and the detection means 160 functionally form a detector 150, 160 for detecting the sliding weight 120 at a certain distance from the fastener.

According to one embodiment, the detector a comprises a sensor arrangement which is mechanical, optical, electric, based on ultrasound, based on electromagnetic radiation and/or magnetic, or other mechanical arrangement which is arranged to detect the sliding of the weight to a particular point, in other words, to the detection limit 170, and to produce a stop signal for the hoist, for example, by causing the switch 160 to switch on or by producing a different signal (e.g. by means of a non-contact sensor).

According to one embodiment, the mechanical sensor arrangement or other mechanical arrangement comprises a turning lever, a push-button, a linear switch and/or a mechanical connection which breaks when the weight 120 reaches the detection limit 170, that is, arrives at the said certain distance from the fastener 110 or detector (or its part, such as the detection means 160).

According to one embodiment, the electric sensor arrangement comprises an inductive, capacitive, piezoelectric and/or resistive sensor.

According to one embodiment, the optical sensor arrangement comprises a sensor arrangement based on a photocell, laser, infrared light or ultraviolet light.

According to one embodiment, the sensor arrangement based on electromagnetic radiation comprises a microwave sensor or radar.

According to one embodiment, the magnetic sensor arrangement comprises a Hall sensor.

According to one embodiment, the weight 120 comprises an element, elements or material which is functionally connected to the detection means 160, for example, an element which the detection means detect.

According to one embodiment, when a mechanical or electromechanical arrangement is used, for example, physical contact, the connection formed by which breaks when the weight 120 reaches the detection limit 170, an element or elements are connected to the weight or the weight is shaped such that when the weight approaches the detection limit 170, a part of it reaches, for example, above the fastener 110 and is attached to a mechanical or electromechanical arrangement which breaks or detaches when the a part of the weight or the element attached to it moves sufficiently far above the fastener 110. An example of such arrangement is an electric wire with a plug or the like which detaches when the weight proceeds to the detection limit 170 and the part of the weight proceeding above the fastener 110 pulls or pushes the electrical connection open and thus switches on the switch 150, which is selected such that disconnection triggers the switch, or such that in this case the disconnection stops the wire rope hoist, in other words, the disconnection corresponds to the switch switching on. According to one embodiment, the length of the mechanical or electromechanical connection disconnected in such situation, for example, the said electric wire, is such that the weight is able to move freely on the wire rope.

Figure 3A:
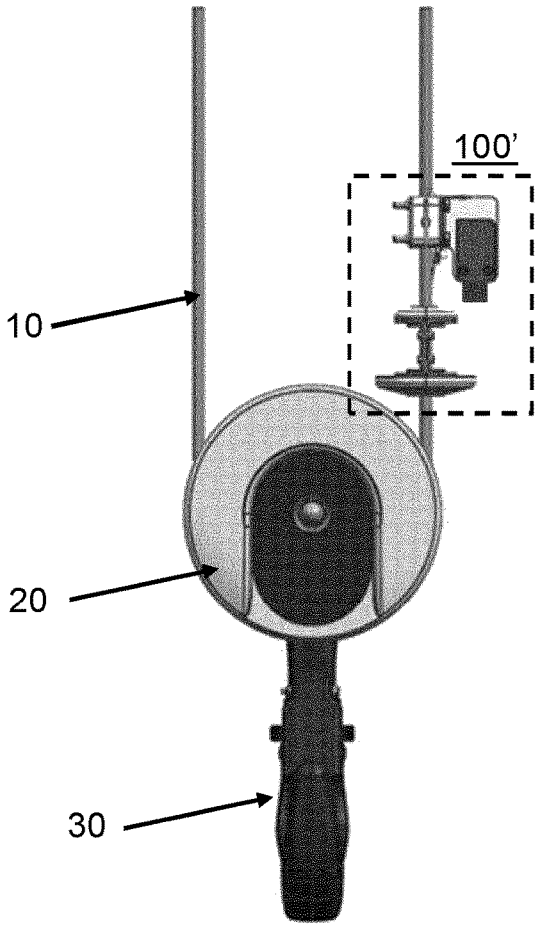
FIGS. 3*a*-3*d* show schematically a wire rope hoist limiter device according to one embodiment.
Figure 3D:
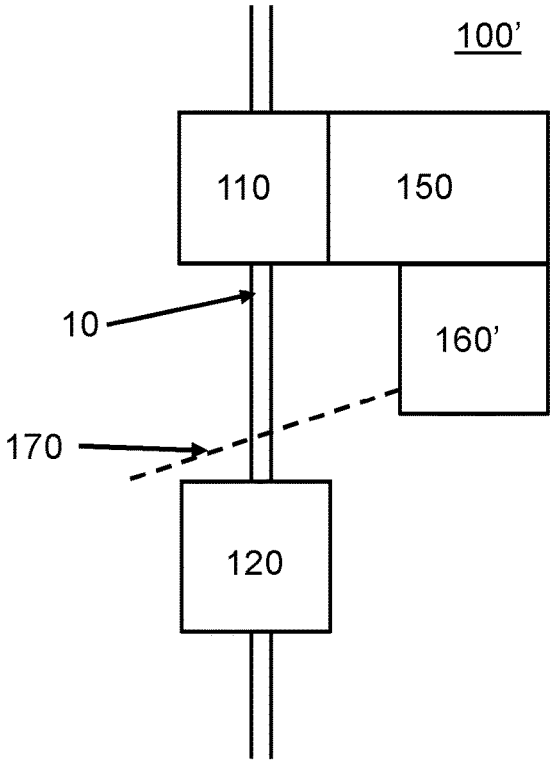
Figure 3B:
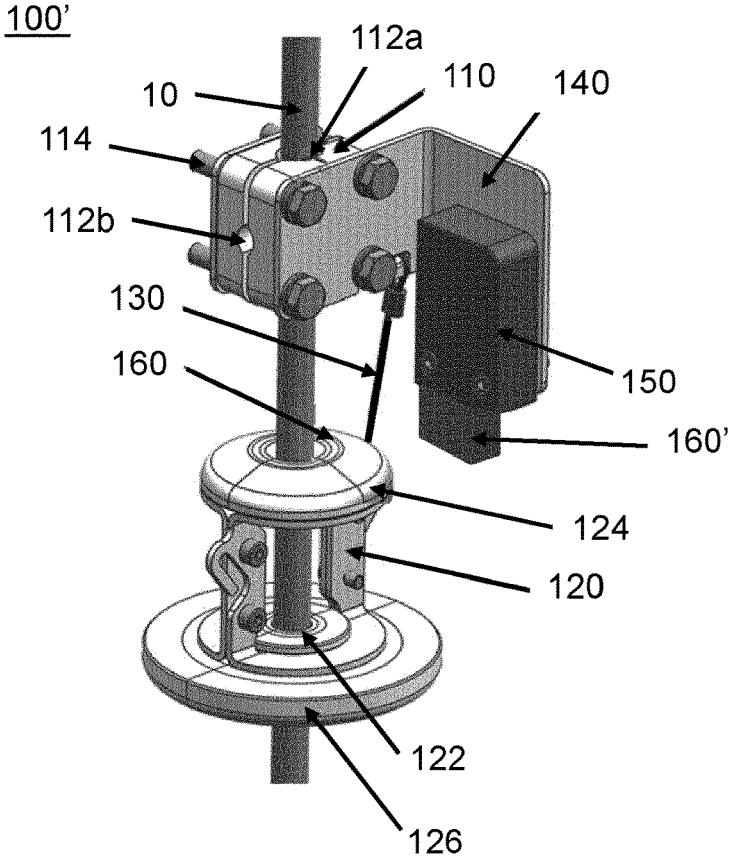
Figure 3C:
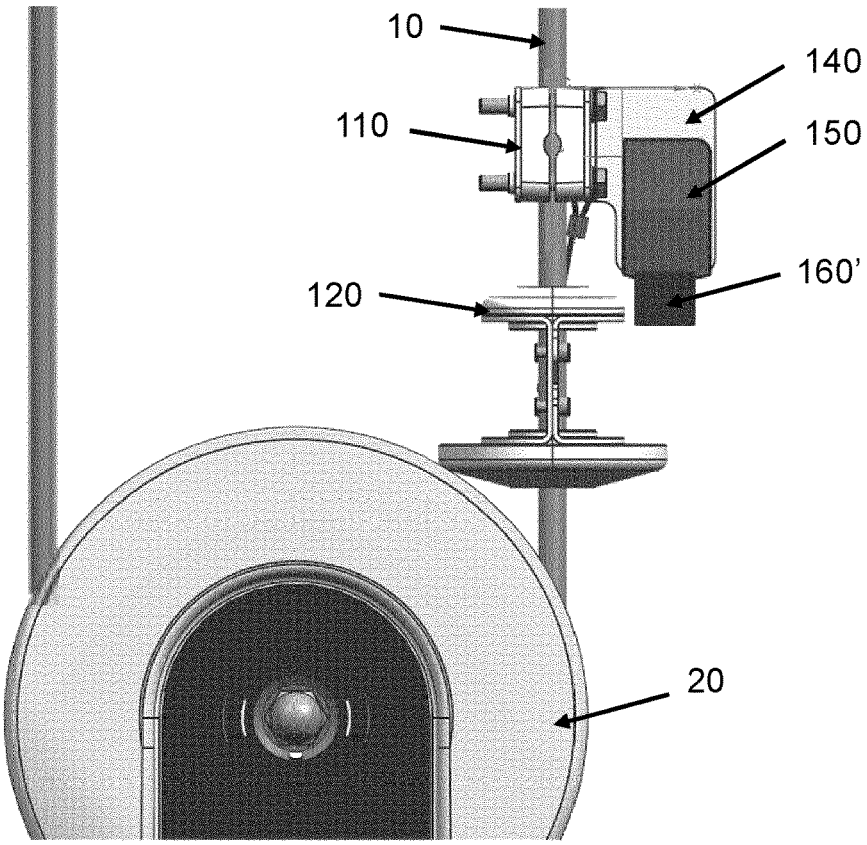

FIG. 3*b* shows schematically the wire rope hoist limiter device 100 according to one embodiment. The limiter device 100 comprises a fastener 110 which is arranged to be fastened to the wire rope 10 of the wire rope hoist, for example, by pressing around the wire rope such that the fastener 110 stays in place in the desired location. The position of the fastener 110 is selected on the basis of the point at which the absolute upper limit of the hook block of the wire rope hoist and/or the lifting of the load is. According to one embodiment of the present disclosure, the limiter device 100 is mounted between the rope end termination and the hook block 20 (FIG. 3*c*). The limiter device 100 may be below the rope end termination.

The fastener 110 is fastened to the wire rope such that the wire rope 10 passes through it via a hole 112*a*. The fastening is carried out, for example, by pressing, in one embodiment of the present disclosure, for example, by means of bolts 114. In one embodiment of the present disclosure, the fastener 110 consists of at least two parts, the wire rope being positioned in an opening 112*a*, 112*b* forming between them, and the parts being then pressed against each other while the fastener 110 is fastened around the wire rope. The structure consisting of at least two parts makes it possible to fasten the fastener 110, and thus the limiter device 100, to the wire rope hoist without having to disassemble the roping or other structures. In one embodiment of the present disclosure, the fastener 110 is fastened at least partly magnetically, by gluing, by casting around the wire rope, by soldering, welding, weaving or sewing to the wire rope. Other fastening methods may be used additionally or alternatively. Other fastening methods include, for example, riveting with blind rivets or using an encircling pressing band, for example, for pressing two parts together.

In one embodiment of the present disclosure, the fastener 110 is arranged to be suitable for fastening to wire ropes of different thicknesses, for example, such that by turning the fastener 110, either a mounting opening 112*a* of the first size or a mounting opening 112*b* of the second size can be utilized. According to one embodiment, the fastener 110 is arranged to be fastened, for example, by means of a mounting opening 112*a* of the first size to a wire rope with a diameter of 12-16 mm, and by means of a mounting opening of the second size to a wire rope with a diameter of 5-11 mm. If there are at least two of the said mounting openings, they may be located adjacent to each other, significantly parallel with each other, or they may be located intersecting each other. Intersecting openings are shown by way of an example in FIG. 1*b*.

The fastener 110 preferably does not affect the durability of the wire rope or the use of the wire rope hoist. In one example of an embodiment, the pressure corresponding to the compressive force with which the fastener 110 is pressed on the wire rope 10 is such that the pressure has no significant effect on the cross-sectional area of the wire rope or its safety limits. Depending on the implementation, the pressure may be, for example, 2, 2.5, 3 or 4 MPa, measured with an accuracy of, for example, 1%, 5%, 10% or 20%.

According to one embodiment, the fastener 110 is made of plastic material, for example injection-molded plastic.

The limiter device 100 further comprises a sliding weight 120 arranged to slide along the wire rope 10 of the wire rope hoist. The weight 120 is mounted around the wire rope, for example, such that the wire rope runs through the opening 122 in the weight, however, such that the weight is able to slide along the wire rope, in other words, the weight is not tightened on the wire rope. In one embodiment, the extreme position of the weight is limited along the wire rope to the hook block 20 at the bottom, or in the lowest permitted position of the flexible fastener if the weight is connected with a flexible fastener 130 to the fastener 110. In one embodiment, the extreme position of the weight along the wire rope is limited at the top to the fastener 130.

According to one embodiment, the weight 120 consists of at least two parts which are attached to each other such that an opening 122 is formed between them for the wire rope to pass through. The parts are attached to each other by conventional means, for example, with screws or bolts, or by using form-locking parts. The structure consisting of at least two parts allows the weight 120, and thus the limiter device 100, to be fastened to the wire rope hoist without having to disassemble the roping or other structures.

According to one embodiment, the weight 120 is shaped such that its end 124 pointing towards the fastener 110 is narrower than the opposite end 126. According to one embodiment, the weight 120 is made of plastic material, for example, injection-molded plastic.

According to one embodiment, the sliding weight 120 is fastened to the fastener 110 by means of a flexible fastener 130 in order for the weight to remain sufficiently close to the fastener 110 when the limiter device 100 is in use, in other words, the weight 120 hangs around the wire rope 10, below the fastener 110, supported by the flexible fastener 130.

According to another embodiment, the flexible fastener 130 comprises a cable, wire rope, wire cable, band or tension spring, such as coil spring. According to another embodiment, the sliding weight is not fastened to the fastener 110 but rests on the hook block of the wire rope hoist. This situation may also arise if the flexible fastener 130 should for some reason give way, in which case the weight 120 will slide onto the hook block of the wire rope hoist, but the limiter device may despite this still function.

The limiter device 100 further comprises a switch 150 which is fastened to the fastener 110, for example, by means of a suitable mounting element 140. When switched on, the switch 150 is arranged to provide a signal for stopping the wire rope hoist and thus for preventing the hook block and/or the load from rising higher than to the detection limit 170 set by the limiter device. According to one embodiment, the switch 150 comprises a microswitch.

The signal from the switch 150 can be transmitted to the control system of the wire hoist in the usual manner, for example, by means of a hook-up wire or wirelessly by using applicable wireless data transfer.

To the switch 150 there are functionally connected detection means 160 (FIGS. 1*b*-1*c*) or 160' (FIG. 3*b*-3*d*), which are arranged to cause the switching on of the switch 150 when the weight 120 approaches the fastener 110 due to the effect of the rising hook block, in other words, rises to its limit position determined by the limiter device.

According to one embodiment, the switch 150 may switch on when the detection means 160, 160' provide a signal to the switch, and in that case the switching on can be carried out from the ascending or descending edge of the signal, or the signal from the detection means 160 will disappear. The signal from the detection means 160 to the switch 150 can be provided in the usual manner, for example, by means of a hook-up wire or wirelessly by using applicable wireless data transfer when wireless data transfer is a permissible data transfer channel in safety devices.

Figure 1C:
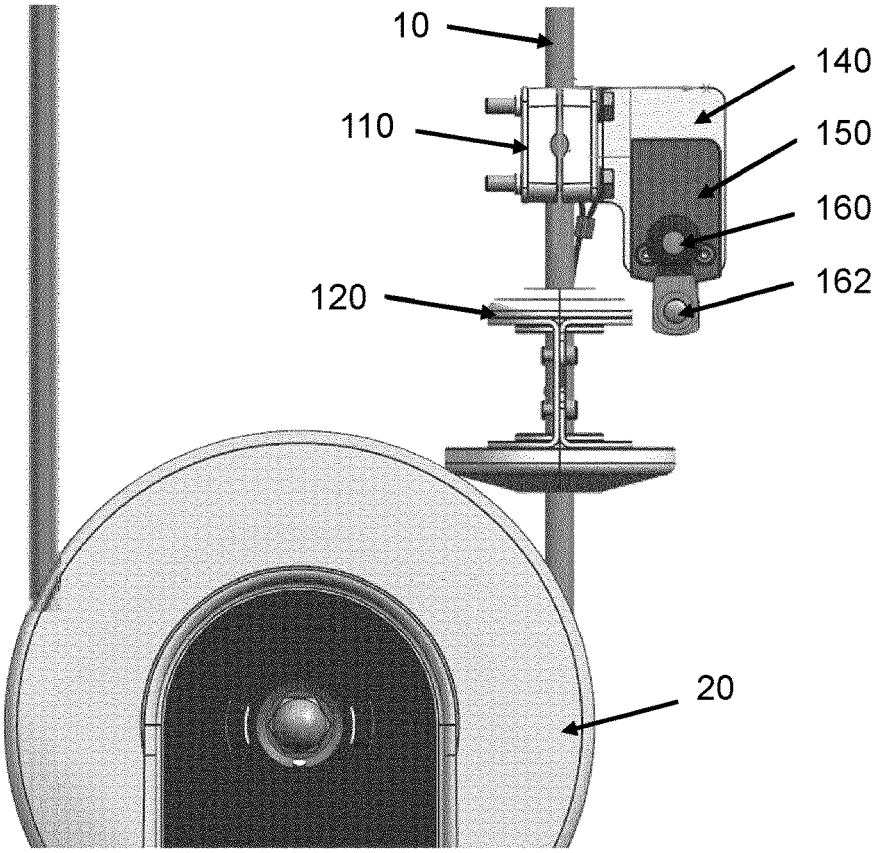

The detection means 160, 160' are arranged such that when the limiter device is used, the sliding weight, or in some embodiments the end 124 of the weight, arrives at the detection limit 170 determined by the detection means 160 as the sliding weight rises towards the fastener 110 when the hook block of the wire rope hoist rises towards its upper limit position and at the same time lifts the sliding weight ahead of it. When the weight or end 124 of the weight 120 arrives at the detection limit 170, and the switch 150 is switched on, the wire rope hoist stops and the rising of the hook block above its upper limit position is prevented. FIG. 1*c* shows this situation, where the limiter device has triggered when the weight 120 has arrived at the detection limit 170 and switched on the switch 150. In the embodiment of FIG. 1*c*, the detection means 160 exit the operating mode in connection with the switching of the switch 150 such that the detection means 160 have to be returned to the operation mode manually in order to return the switch 150 to operation readiness.

The flexible fastener 130 may bend to a side as the weight 120 rises upwards, whereupon its effective length is reduced in the desired manner. The effective length of the flexible fastener 130 is at its greatest when the weight 120 is suspended on the flexible fastener 130.

The weight 120 is preferably a rotationally symmetrical body by its main dimensions with respect to its central axis, the wire rope 10 being adapted to run in the hole fitted through the said central axis. The weight 120 preferably comprises a rotationally symmetrical surface on the outer surfaces of the end 124, such as on the upper surface, and on the outer surfaces of the end 126, such as on the lower surface. The surfaces of these ends 124, 126 may be the shape of an open fly *amanita* (*amanita muscaria* in Latin) or bolete mushroom cap or a spherical cap. The outer diameter of end 124 may be smaller than the outer diameter of end 126. The weight 120 may be freely rotating around the wire rope 10. The weight 120 may comprise surfaces or shapes deviating from the rotationally symmetrical in the section between the ends 124, 126 and/or in the parts attached to the wire rope. The outer diameters of the ends 124, 126 of the weight 120 are dimensioned such that the outer diameters of the ends 124, 126 are sufficiently large for forming a reliable contact on the planned surfaces and further to facilitate the detection carried out by the detection means 160, 160' to switch on the switch 150 when the hook block 20 approaches its upper limit.

According to one embodiment, the diameter of the sliding weight 120 may be significantly close to the diameter of the wire rope 10 but, however, in size and/or material such that the detection means 160, 160' detect its arrival at the detection limit 170. According to one embodiment, the weight 120 comprises a sleeve or the like around the wire rope 10, which sleeve is of a material which the detection means 160' detect, for example, the weight 120 may comprise a sleeve of ferromagnetic material around a synthetic wire rope or a sleeve with a specifically reflective surface which can be optically detected.

In one embodiment, the weight 120 can still move upwards along the wire rope after detection by the detection means 160, 160' for a sufficient distance to stop the wire rope limiter before the weight 120 makes impact with the fastener 110. In one embodiment, the sufficient distance is approximately 30 mm, which is enough to stop the wire rope hoist. The wire rope 10 is preferably fastened above the fastener 110 to a rope end termination. The end termination may be, for example, in the trolley of the hoist.

Figure 2:
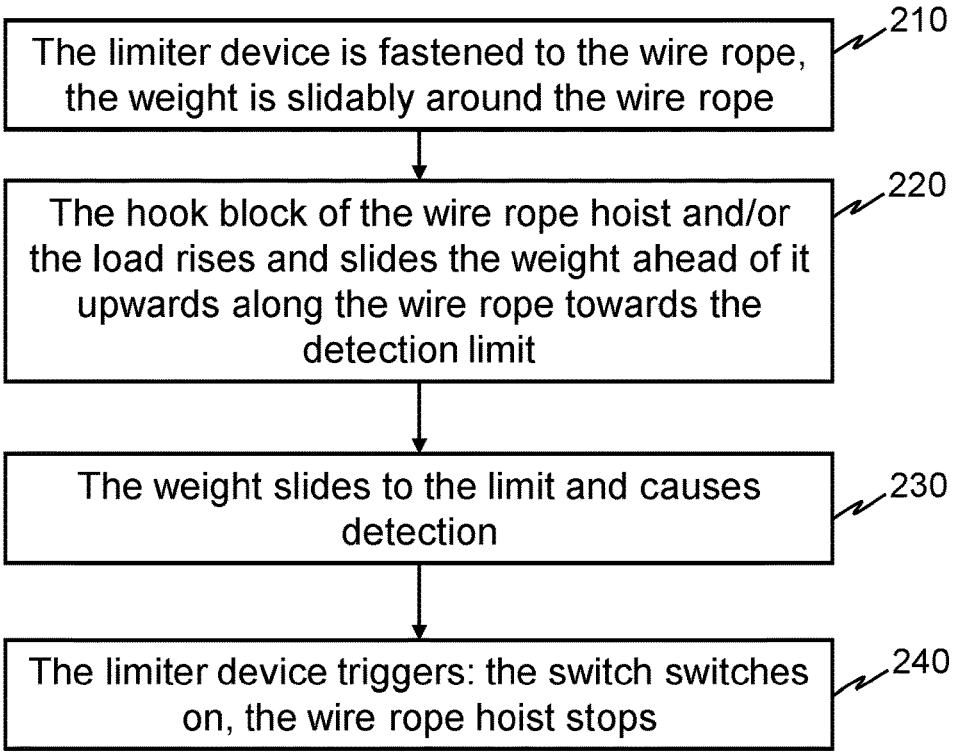
FIG. 2 shows a simplified drawing of a limiter method according to one embodiment of the present disclosure.

According to one embodiment, in the case of odd rigging of the wire rope hoist, in other words, where the number of falls is odd—for example 1×3 or 1×5—and the rope end termination is located in the hook block 20, the limiter device 100 is located such that it operates upside down compared to the embodiment shown in FIGS. 1-3. In this embodiment, the weight 120 may rest on the detection means 160 comprising a mechanical arrangement, and the mass of the weight 120 and/or the force required by the mechanical detection means 160 is selected such that the weight 120 alone cannot cause detection and switch on the switch 150, but the switch is only switched on when the hook block is rises to its extreme limit and the weight 120 presses against the mechanical arrangement comprised in the detection means 160 by the effect of an external force. In this embodiment, the weight is, according to yet another embodiment, in the same position as depicted in FIGS. 1-3, as long as the outer diameter of the ends 124, 126 of the weight is sufficient for forming a reliable contact with the intended surfaces and further to achieve detection in order to switch on the switch 150, when the hook block 20 approaches its upper limit.

FIG. 2 shows a simplified drawing of the limiter method according to one embodiment of the present disclosure.

In step 210, the limiter device 100 is mounted in place in the wire rope hoist. The fastener 110 is pressed around the wire rope 10 at a point where the hook block of the wire rope hoist and/or the upper limit location of the load is to be located. The sliding weight 120 is mounted in a sliding manner around the wire rope 10 and in one embodiment is suspended by means of the flexible fastener 130 on the fastener 110. The detection means 160, 160' have not detected the weight and the switch 150 has, therefore, not been switched on, and thus the wire rope hoist can operate normally.

In step 220, the hook block of the hoist and/or the load rises upwards towards its upper limit location. At the same time, it slides the weight 120 ahead of it upwards along the wire rope towards the detection means 160, 160'.

In step 230, as the hook block and/or the load continues to rise towards its upper limit location, the upper end 124 of the weight 120 arrives at a certain distance from the fastener 110 or the detection means 160, 160', that is, at the detection limit 170, and causes detection.

In step 240, the limiter device triggers, in other words, the detector gives a signal to stop the wire rope hoist. In the embodiment of FIG. 1*b*, the switch 150 switches on once the detection means 160 have detected the weight 120 at the detection limit 170 and the wire rope hoist stops. In one embodiment, such as in FIG. 1*c*, the detection means 160 remain in the mode in which the detection has taken place until they are manually or otherwise returned to the operation mode. In some embodiments, the detector comprises a contact or non-contact sensor or switch which carries out the detection in step 230 and gives the stop signal in step 240 instead of a separate switch 150 and detection means 160, 160'.

Figure 4:
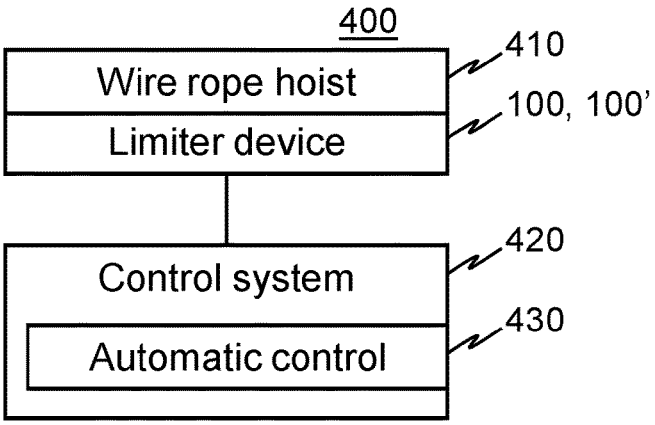
FIG. 4 shows a simplified drawing of a limiter system according to one embodiment of the present disclosure.

FIG. 4 shows a simplified drawing of a system 400 according to one embodiment of the present disclosure. The system 400 comprises a wire rope hoist 410, a limiter device 100, a control system 420 and optionally an automatic control 430.

One technical advantage of the present disclosure disclosed in the foregoing is that it provides a limiter device which is simple to mount on different types of wire rope hoists without changing or disassembling their structure.

Another technical advantage of the disclosed embodiments disclosed above may be considered to be the improved safety of the limiter device. In some embodiments, when the detection means 160 have detected the weight 120, they have to be separately returned to the operating mode. This ensures that the operator will notice that the safety limit has been switched on and the usual limiters have failed. In this way, there may be prevented a potential hazard which might arise if the operator was only alerted of the switching on of the safety limit by a warning signal. The operator does not necessarily notice the warning signal or understand its significance. Thus, the operator does not become aware of any failures in the wire rope hoist and this will pose a serious risk to life and health. Potentially, the warning signal might be given precisely at the change of work shift and the information about the warning signal might not be conveyed to the following work shift due an error of communication. However, in some other embodiments, the said warning signal may in addition or alternatively be given due to the detection means 160 having exited the operation mode.

In addition to the limiter device disclosed above, the hoist may also comprise another limiter device, the limiter devices being connected to separate safety circuits by way of an example. These separate safety circuits may have different safety specification levels, for example, a more lenient safety specification and a more critical safety specification. In one example, in a more lenient safety circuit, after the switching on of the upper limit, it is still possible to guide the hook block 20 downwards by using the operator's control device. In a more critical safety circuit, restoring the hoist into working order after exceeding the upper limit requires separate measures which cannot necessarily be carried out on the operator's control devices.

By means of some embodiments of the present disclosure there can be provided a limiter device which is simple and economical to produce. With some embodiments of the present disclosure, a limiter device can be provided with which many of the potential failures of prior art may be avoided. Some embodiments of the present disclosure enable relatively easy mounting of the limiter device, on account of which the limiter device can easily be mounted as a new device or as a replacement for a previous limiter device in the wire rope hoist by retrofitting, for example, in connection with maintenance. Some embodiments of the present disclosure enable operation of the limiter device which is not prevented by the breaking of the elastic or flexible parts. Some embodiments of the present disclosure produce a stop signal on the basis of the force of the wire rope hoist such that the wire rope hoist generates the force transmitted to the switch or that the wire rope hoist lifts the sliding weight to the detection limit. By means of some embodiments of the present disclosure is enabled mechanically forced switching without flexible elements between the sliding weight and the detector.

The description disclosed in the foregoing provides non-limiting examples of some embodiments of the present disclosure. It is apparent to a person skilled in the art that the disclosed embodiments are not limited to the details disclosed but that the disclosed embodiments may also be implemented in other equivalent ways.

The switching on of the switch may refer to a change in the operating mode of the switch such that a stop signal of the wire rope hoist is produced. The switching on of the switch may refer to performing functional limit switching of the wire rope hoist by changing the mode of the switch, which may mean forming an electrical connection or disconnecting an electrical connection. In some embodiments, the stop signal may occur as producing, discontinuing or changing of the electrical signal from one mode to another. In some embodiments, the stop signal is transmitted by other means than electrically, for example, optically by means of an optical fiber.

Some of the features of the afore-disclosed embodiments of this present disclosure may be used to advantage without the corresponding use of other features. As such, the foregoing description shall be considered as merely illustrative of the principles of the present disclosure, and not in limitation thereof. Hence, the scope of the disclosed embodiments is only restricted by the appended patent claims.

The invention claimed is:

1. A wire rope hoist limiter device, comprising:

a fastener, which is arranged to fasten around a wire rope of a wire rope hoist;

a sliding weight arranged to slide along the wire rope of the wire rope hoist towards the fastener;

a detector, which is arranged to be fastened to the wire rope of the wire rope hoist by means of the fastener;

wherein:

the detector is arranged to detect the sliding weight at a certain distance from the fastener and to give a stop signal for the wire rope hoist in response;

the detector comprises detection means and a switch fastened to the fastener;

when switched on, the switch is arranged to provide a signal for stopping the wire rope hoist;

the detection means are arranged to cause the switching on of the switch;

the sliding weight comprises a first end;

the first end is arranged to switch on the switch; and the first end is arranged to switch on the switch by making impact with the switch or a lever connected to the switch for mechanically forced switching without flexible elements between the sliding weight and the detector.

2. The wire rope hoist limiter device according to claim 1, wherein the sliding weight is fastened to the fastener by means of a flexible fastener such that the sliding of the sliding weight further from the fastener than the length of the flexible fastener is prevented.

3. The wire rope hoist limiter device according to claim 2, wherein the detector is arranged to detect the sliding weight at a certain distance from the fastener on the basis of the force of the wire rope hoist.

4. The wire rope hoist limiter device according to claim 2, wherein the detector is arranged to detect the sliding weight at a certain distance from the fastener even if the flexible fastener breaks.

5. The wire rope hoist limiter device according to claim 2, wherein the flexible fastener comprises one or more of the following: a cable, rope, wire cable, band, tension spring.

6. The wire rope hoist limiter device according to claim 2, wherein the detection means comprise a contact arrangement.

7. The wire rope hoist limiter device according to claim 2, wherein the fastener is arranged to fasten to the wire rope of the wire rope hoist by pressing.

8. The wire rope hoist limiter device according to claim 2, wherein the fastener is arranged to be fastened to different sizes of wire ropes by providing various sizes of openings.

9. The wire rope hoist limiter device according to claim 4, wherein the flexible fastener comprises one or more of the following: a cable, rope, wire cable, band, tension spring.

10. The wire rope hoist limiter device according to claim 1, wherein the detector is arranged to detect the sliding weight at a certain distance from the fastener on the basis of the force of the wire rope hoist.

11. The wire rope hoist limiter device according to claim 1, wherein the detection means comprise a contact arrangement.

12. The wire rope hoist limiter device according to claim 1, wherein the detection means comprise a contactless arrangement.

13. The wire rope hoist limiter device according to claim 1, wherein the weight comprises an element, elements or material functionally connected to the detection means.

14. The wire rope hoist limiter device according to claim 1, wherein the sliding weight consists of at least two parts attached to each another with an opening between them in which the wire rope of the wire rope hoist is arranged to run.

15. The wire rope hoist limiter device according to claim 1, wherein the fastener is arranged to fasten to the wire rope of the wire rope hoist by pressing.

16. The wire rope hoist limiter device according to claim 1, wherein the fastener is made of at least two parts which are arranged to be attached to each other such that the wire rope of the wire rope hoist is pressed in an opening between the parts.

17. The wire rope hoist limiter device according to claim 1, wherein the fastener is arranged to be fastened to different sizes of wire ropes by providing various sizes of openings.

18. A wire rope hoist control system comprising a wire rope hoist limiter device, wherein the wire rope hoist limiter device comprises:

a fastener, which is arranged to fasten around a wire rope of a wire rope hoist;

a sliding weight configured to slide along the wire rope of the wire rope hoist towards the fastener;

a detector, which is configured to be fastened to the wire rope of the wire rope hoist by means of the fastener;

wherein:

the detector is configured to detect the sliding weight at a certain distance from the fastener and to give a stop signal for the wire rope hoist in response;

the detector comprises detection means and a switch fastened to the fastener;

when switched on, the switch is configured to provide a signal for stopping the wire rope hoist;

the detection means are configured to cause the switching on of the switch;

the sliding weight comprises a first end;

the first end is arranged to switch on the switch; and the first end is configured to switch on the switch by making impact with the switch or a lever connected to the switch for mechanically forced switching without flexible elements between the sliding weight and the detector.

19. The wire rope hoist control system according to claim 18, wherein the wire rope hoist control system further comprises automatic control for controlling the wire rope hoist.

* * * * *